United States Patent [19]

Kuwahara et al.

[11] Patent Number: 4,653,163

[45] Date of Patent: Mar. 31, 1987

[54] METHOD FOR PRODUCING A HEAT TRANSFER WALL FOR VAPORIZING LIQUIDS

[75] Inventors: Heikichi Kuwahara, Ibaraki; Kenji Takahashi, Abiko; Takehiko Yanagida, Tsuchiura; Wataru Nakayama, Kashiwa; Shigeo Sugimoto; Yoshihiko Nakayama, both of Ibaraki; Hiromichi Yoshida, Hitachi; Kiyoshi Oizumi, Tsuchiura; Toshi Sasaki, Hitachiota; Shigeho Fukuda, Hitachi, all of Japan

[73] Assignees: Hitachi, Ltd.; Hitachi Cable, Ltd., both of Tokyo, Japan

[21] Appl. No.: 769,749

[22] Filed: Aug. 27, 1985

[30] Foreign Application Priority Data

Sep. 14, 1984 [JP] Japan ..... 59-191578
Oct. 30, 1984 [JP] Japan ..... 59-228723

[51] Int. Cl.[4] ..... B21D 53/02; B23P 15/26; B23P 13/04

[52] U.S. Cl. ..... 29/157.3 R; 29/558; 165/133

[58] Field of Search ..... 29/557, 558, 157.3 R; 165/133

[56] References Cited

U.S. PATENT DOCUMENTS

| | | | |
|---|---|---|---|
| 3,454,081 | 7/1969 | Kun et al. | 29/157.3 R |
| 3,906,604 | 9/1975 | Kakizaki et al. | 29/157.3 R |
| 3,971,435 | 7/1976 | Peck | 29/157.3 R |
| 4,060,125 | 11/1977 | Fujie et al. | 29/157.3 R |

*Primary Examiner*—Howard N. Goldberg
*Assistant Examiner*—Irene Graves Golabi
*Attorney, Agent, or Firm*—Antonelli, Terry & Wands

[57] ABSTRACT

A method of producing a heat transfer wall, including a plurality of minute tunnels parallelly extending and spaced a minuscule distance from each other under an outer surface of the wall in contact with liquid, and a plurality of tiny hole portions formed at the outer surface of the wall above the tunnels and located at regular intervals along the tunnels to maintain same in communication with the outside. Each hole portion includes a projection located in the hole portion including a hole itself and extending from the vicinity of the hole portion into the hole portion in a manner to traverse same, so that a flow of liquid into the tunnels and a flow of vapor out of the tunnels can be optimally regulated by the projections to enable the heat transfer wall to exhibit a high heat transfer performance.

2 Claims, 18 Drawing Figures

METHOD FOR PRODUCING A HEAT TRANSFER WALL FOR VAPORIZING LIQUIDS

BACKGROUND OF THE INVENTION

This invention relates to a heat transfer wall capable of advantageously transferring heat to liquids which are brought into contact therewith by vaporizing and boiling the liquids and more particularly to a method of producing such heat transfer wall.

In, for example, U.S. Pat. No. 4,060,125 one known heat transfer wall for advantageously transferring heat to a liquid from a surface of a plate or a tube in contact therewith by vaporizing the liquid, such as Freon, is proposed wherein a plurality of parallel rows of elongated minute tunnels, spaced apart a minuscule distance from each other, are formed under the wall surface, and each minute tunnel is communicated with the outside by a plurality of tiny holes formed at regular intervals of a minuscule dimension at the wall surface along the tunnel.

Marked advances have in recent years been made in the progress of technology for manufacturing equipment which uses the heat transfer wall of the above described type, resulting in a miniaturization of the equipment and an improvement in the performance thereof. Thus, the provision of an improved heat transfer wall having an improved heat transfer characteristic has been earnestly desired.

The aim underlying the present invention essentially resides in providing a method of producing a heat transfer wall having an improved heat transfer characteristic.

The outstanding feature of the invention enabling the aforesaid object to be accomplished is that a projection is provided to each of a plurality of hole portions formed at a surface of the heat transfer wall and extends from the vicinity of each hole portion including a hole itself in a direction in which the projection traverses the hole portion whereby flows of fluids (gas and liquid) through the hole portion can be regulated to enable the heat transfer wall to exhibit an improved performance in transferring heat.

DETAILED DESCRIPTION

Figure 1:
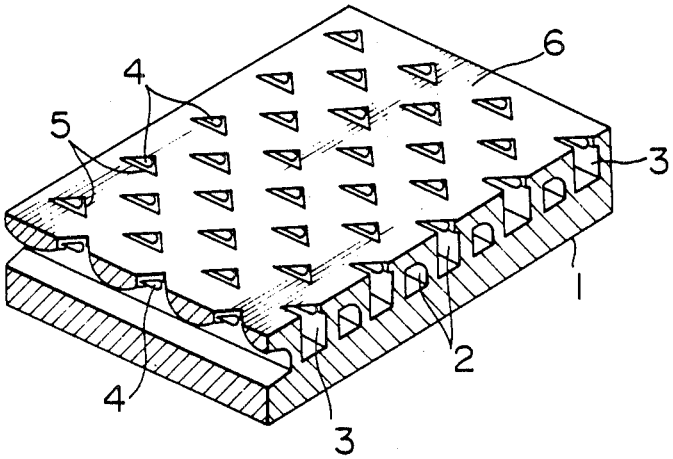
FIG. 1 is a partially schematic cross-sectional view of a portion of a surface of the heat transfer wall produced by the method according to the invention.
Figure 2:
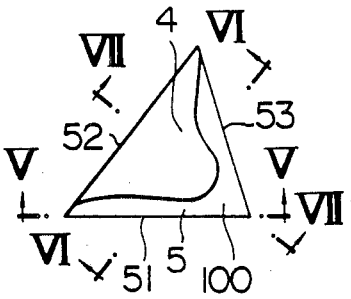
FIGS. 2–4 are plan views, on an enlarged scale, of one of the hole portions formed at the surface of the heat transfer wall shown in FIG. 1.
Figure 3:
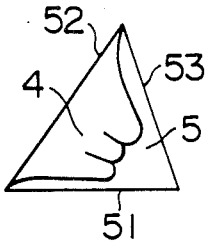
Figure 4:
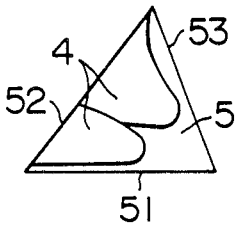

Referring now to the drawings wherein like reference numerals are used throughout the various views to designate like parts and, more particularly, to FIG. 1, according to this figure, a plurality of parallel minute tunnels 2 are and spaced apart from each other by a minuscule distance and are formed in a body 1 of the heat transfer tube. A plurality of holes 5 of substantially triangular configuration are formed on an outer surface 6 above each tunnel 2 and located at regular intervals. A projection 4, of any desired shape as provided in each hole 5. Two-dimensionally, the projection 4 is smaller in size than the triangular hole 5, as shown in FIG. 2, and protrudes into the triangular hole 5 from one side 52 of the hole 5 which extends from another side 51 located parallel to the associated tunnel 2 and represents an extension of one surface of a wall 3 of the tunnel 2. Still another side 53 extends from the side 51 and crosses the side 52, to complete the triangular shape of the hole 5. Thus, the projection 4 protrudes into the hole 5 in a manner to traverse and partly block same. As shown in FIG. 3, the projection 4 may be split at its forward end portion; and, as shown in FIG. 4, the projection 4 may be shaped to have two tongues at its forward end portion.

Three-dimensionally, the projection 4 extending from one side 52 of the triangular hole 5 is inclined by 5°–80° so that it is lower in level on the side of the junction of the two sides 52, 53 than on the side of the junction of the two sides 51, 52. The projection 4 may be inclined such that a base thereof is substantially parallel or perpendicular to the outer surface 6 and its forward end portion is twisted.

In accordance with method of producing the heat transfer wall of the present invention, as shown in FIGS. 8–12, a plurality of shallow grooves 7 are formed on the surface of the body 1 of the material for forming the heat transfer wall. The plurality of fins 11 are formed by locally scraping different zones of the surface of the body 1 in such a manner so as to scrape the surface across the shallow grooves 7 without cutting away the surface layer, and a forward end portion of each fin 11 is bent sideways into intimate contact with the adjacent fin 11, with each of the steps of the present invention being sequentially followed.

Figure 8:
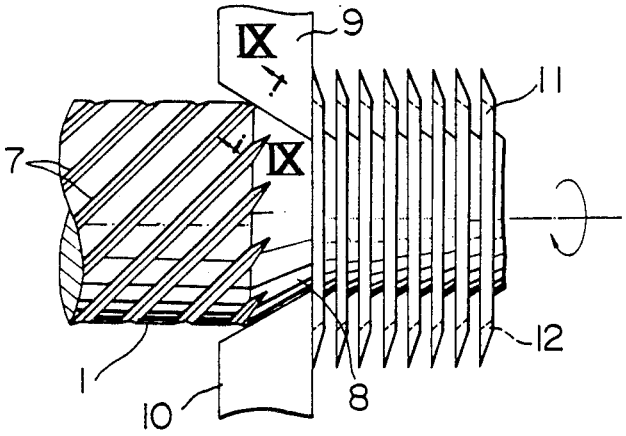
FIG. 8 is a side view depicting the manner in which the fins are formed in one embodiment of the method for producing a heat transfer wall according to the invention.
Figure 9:
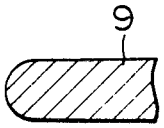
FIG. 9 is a partial cross-sectional view in the direction of arrows IX—IX in FIG. 8.
Figure 10:
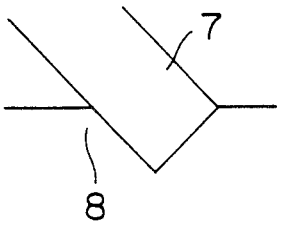
FIGS. 10 and 11 are schematically each showing views each showing respectively depicting an end portion of a shallow groove.

In forming the shallow grooves 7, the body or tube 1 of heat transfer material, which may be a copper tube of an outer diameter of 18.0 mm and a wall thickness of 1.1 mm, has its outer surface worked by a knurling tool, as shown in FIGS. 8 and 10, in such a manner that the shallow grooves 7 of V-shaped cross-sectional shape and inclined by 45° with respect to the axis of the tube 1, are formed in convolutions extending helically in close proximity to each other on the outer surface of the wall of the tube 1. The shallow grooves thus formed are preferably spaced apart from each other by a spacing interval of 0.2–1.0 mm. In the above described embodiment, the spacing interval is 0.5 mm, and the shallow grooves 7 each have a depth of 0.1–0.5 mm.

The shallow grooves 7 have been described as having a V-shaped cross-sectional configuration; however, it is to be understood that the invention is not limited to this specific cross-sectional configuration, and that the cross-sectional configuration of the shallow grooves 7 may be, for example, form as U-shaped, trapezoidal or arcuate. Although the shallow grooves 7 have been described as being formed by knurling, the invention is not limited to this specific form of working and roll forming using a knurling tool or machining using a cutting tool may form the shallow grooves 7.

Figure 12:
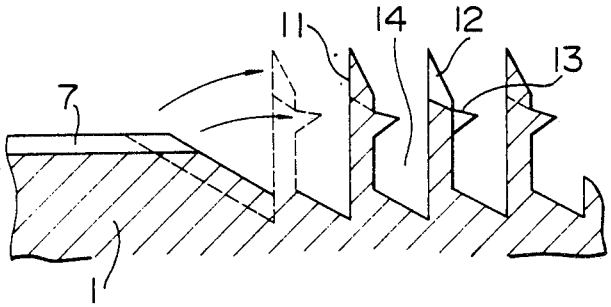
FIG. 12 is a partial cross-sectional view of of the fins.

In the step of forming the fins 11 following the step of forming the shallow grooves 7, the outer surface of the tube 1 is machined by using a cutting tool 10 in such a manner so as to scrape the outer surface across the shallow grooves 7 without cutting away the surface area, as shown in FIGS. 8 and 12, so as to thereby form, on the outer surface of the wall of the tube 1, a plurality of tiny fins 11 separated from each other by a gap 14 greater in dimension than the depth of a cut made into the surface layer of the tube 1 and each having at the forward end portion a V-shaped cutout 12, and in the vicinity of a valley a protuberance 13. By using a machined surface deforming tool 9 in addition to the cutting tool 10 as shown in FIG. 8, it is possible to readily form the protuberance 13 in the vicinity of the valley of the cutout 12 of each fin 11.

Figure 11:
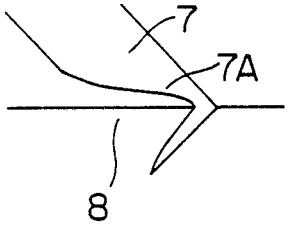

Immediately after the fins 11 are formed, the shallow grooves 7, located at a machined surface 8, are configured such that, as shown in FIG. 10, the V-shaped profile of each shallow groove 7 can be clearly seen without being distorted. After the fins 11 are formed, the deforming tool 9 of a cross-sectional shape shown in FIG. 8 is forced against the machined surface 8 to deform in one direction each shallow groove 7 as indicated at 7A in FIG. 11. By moving the deforming tool 9 relative to the cutting tool 10 in the same direction, while forcing the former against the machined surface 8 to thereby rub the machined surface 8, the material of the machined surface 8 in the vicinity of the V-shaped shallow grooves 7 is caused to flow into the grooves 7, thereby blocking a portion of each groove 7 as shown in FIG. 11 or deforming the end portion 7A of each shallow groove 7 as if it were covered with the material. After the machined surface 8 is deformed as described hereinabove, the surface of the tube is locally scraped by the cutting tool 10 for forming the fins 11 without cutting away the surface layer. Thus, the fins 11, shown in FIG. 12, are formed in which each fin 11, has at the forward end portion, the V-shaped cutout 12 which is a trace of each shallow groove 7 and, in the vicinity of the valley of the cutout 12, the protuberance 13. The portions 7A of the grooves 7 that have been deformed at the machined surface 8 in such a manner so to block each of the shallow grooves 7 are each deformed into the protuberance 13 as each fin 11 is formed by scraping the outer surface without cutting away the surface layer of the tube 1. The tiny fins 11 are preferably formed at a spacing interval of 0.2–1.5 mm.

In the above-described embodiment, the fin forming operation was performed on the copper tube 1 formed with preformed shallow grooves 7 as described hereinabove. The conditions of the fin forming operation included a cutting angle of 25°, a spacing interval between the fins of 0.5 mm and a cutting depth of 0.35 mm, and the fins 11, produced as a result of the operation, had a height of 0.90 mm and were arranged in helical convolutions having an inclination of substantially 90° with respect to the center axis of the copper tube 1. In the above-described embodiment, a portion of the cutting tool 10 functioned as the deforming tool 9 so that the machined surface 8 was rubbed thereby immediately after the surface area of the tube 1 is scraped without cutting away the surface layer. Thus, the protuberance 13 was formed in the vicinity of the valley of the cutout 12 of each fin 11.

After the fins 11, each having the protuberance 13 in the vicinity of the valley of the cutout 12, are formed, the step of deforming the forward end portion of each fin 11 is performed. In this step, the forward end portion of each fin 11 is bent toward the side on which the protuberance 13 is located into intimate contact with an intermediate portion of the adjacent fin 11. As a result, the gap 14 that separated the fins 11 from each other is closed at its top. Thus, as shown in FIG. 1, the minute tunnels 2 communicating with the outside through the tiny holes 5 which are the products of the deformation of the cutouts 12 of the fins 11 are formed below the outer surface 6 which is constituted by the forward end portions of the fins 11 that have been deformed. The protuberances 13 in the vicinity of the valleys of the cutouts 12 of the fins 11 are deformed into the projections 4 each appearing in one of the tiny holes 5.

In bending the forward end portion of each fin sideways, a flat roll may be used to crush the forward end portion of each fin 11, or a die may be used to draw each fin 11.

In the above-described embodiment, the copper tube 1 formed with the fins 11 each having the protuberance 13 was rotated about its center axis and moved axially at the same time while a flat roll was maintained in contact with its outer periphery, so as to reduce its outer diameter to 18.30 mm by the pressure applied by the flat roll. In this operation, the holes 5 of substantially triangular configuration were formed at regular intervals at the outer surface 6 above each tunnel 2. The holes 5, each having an imaginary inner circle of a diameter of about 0.2 mm, were each formed with the projection 4 extending into the interior of each hole 5, as shown in FIG. 2. Each tunnel 2 below the outer surface 6 had a width of about 0.26 mm and a height of about 0.50 mm.

The inclination of the projection 4 renders a narrow gap 100 (FIG. 2) defined between the hole 5 and projection 4 along the projection 4 non-uniform in shape both two-dimensionally and three-dimensionally. The presence of the non-uniform gap 100 clearly separates a section of the hole 5 for bubbles of vapor to flow therethrough out of the tunnel 2 from a section of the hole 5 for a liquid to flow therethrough into the tunnel 2, thereby enabling the two flows of fluid to be effectively regulated. The non-uniformity of the narrow gap 100 can be obtained by varying the configuration or position of the projections 4 from each other with respect to the holes 5 or by varying the thickness of the edge of the projections 4 and/or the holes 5. When the non-uniformity of the narrow gap 100 is obtained in this way, the projections 4 need not be inclined with respect to the wall surface 6.

The holes 5 and projections 4 may have a variety of combinations of shapes and configurations. The flow of vapor released from the tunnels 2 through the holes 5 having the projections 4 offers resistance to the flow of a liquid led into the tunnels 2 through the holes. Thus, an optimum vapor passageway area should be determined to suit the volume of released vapor. The heat transfer surface, provided by the heat transfer wall according to the invention, can have a high heat transfer characteristic and exhibit an improved performance when a vapor passageway area provided thereby is in the range of optimum values.

Figure 13:
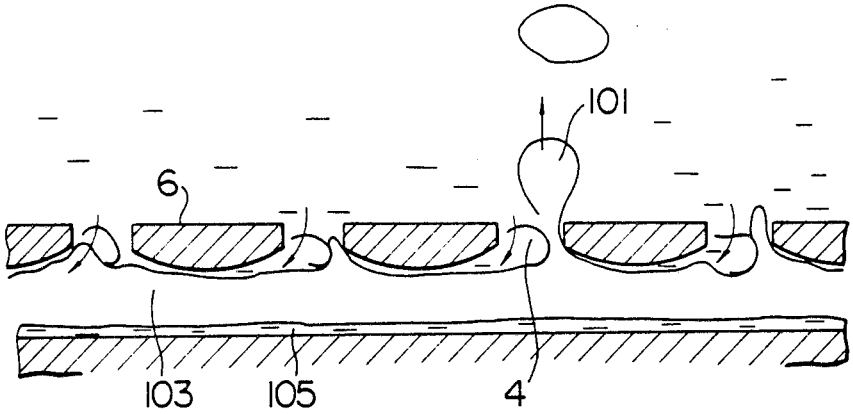
FIGS. 13–15 are schematic cross-sectional views depicting the manner in which a liquid in contact with the heat transfer wall boils.

When the heat transfer tube 1 of the surface area construction as described hereinabove is heated by temperatures higher than the temperature of a liquid brought into contact therewith to boil, vapor bubbles 103 are produced in each tunnel 2 as shown in FIG. 13.

FIG. 13 shows the entire wall surface of the tunnel 2 covered with a liquid film 105. When the tunnel 2 is in this condition, the heat transfer surface of the heat transfer wall according to the invention operates in a favorable condition and exhibits a high boiling heat transfer performance. More specifically, when the heat transfer surface is heated, the heat is transferred from the inner wall surfaces of the tunnel 2 to a liquid in the tunnel 2. In the case of the heat transfer surface shown in FIG. 13, all the inner wall surfaces of the tunnel 2 take part in effective transfer of heat. Thus, when the heat transfer wall 1 is heated, the heat of the heat transfer wall 1 is first transferred to the liquid film 105. The liquid film 105 is small in thickness, so that the liquid quickly vaporizes, thereby removing the latent heat of vaporization from the inner wall surfaces of the tunnel 2. As soon as the inner wall surfaces of the tunnel 2 become dry, the liquid is supplied through the holes 5 to the tunnel 2 and a new liquid film 105 is formed on the entire wall surface of the tunnel 2. Thus, the liquid film 105 of a uniform small thickness covers the entire wall surface of the tunnel 2 at all times during operation.

When the heat transfer tube 1 is not vigorously heated, the volume of vapor produced in the tunnel 2 is small. Assume that the liquid is a refrigerant in a liquefied state, then the resistance offered by the flow of the gaseous refrigerant released from the tunnel 2 to the outside to the flow of the liquefied refrigerant entering the tunnel 2 is small, so that the entry of the liquefied refrigerant into the tunnel 2 is facilitated. As a result, the tunnel 2 is partially filled with the liquefied refrigerant as indicated at 106 in FIG. 14. The tiny projections 4 according to the invention perform the function of heating the liquefied refrigerant flowing into the tunnel 2 through the holes 5. Therefore, the regions of the tunnel 2 filled with the liquefied refrigerant are smaller than would be the case if no projections 4 were provided and the liquefied refrigerant were allowed to freely enter the tunnel 2. Thus, the heat transfer wall according to the invention provided with the projections 4 can exhibit a high boiling performance.

Figure 14:
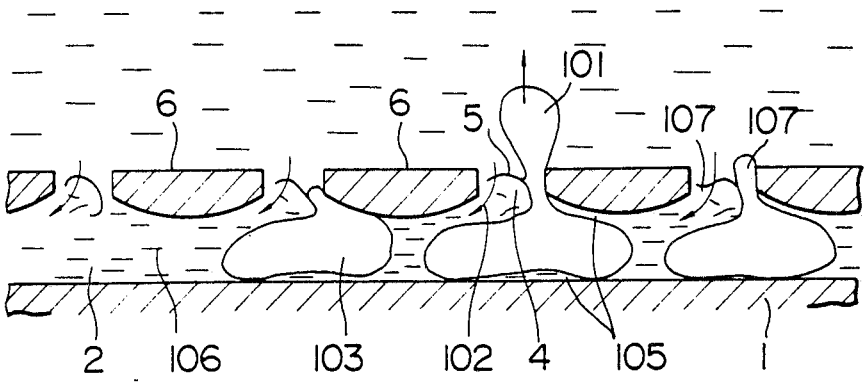

When the tunnel 2 is in the condition shown in FIG. 14, the area of the surface of the liquid film 105 in which vaporization takes place is naturally reduced. In the regions of the tunnel 2 that are filled with the liquefied refrigerant, heat is transferred in the form of a sensible heat produced as the liquefied refrigerant is heated. When the heat is transferred in the form of sensible heat, the heat transfer performance is greatly reduced as compared with the transfer of heat in the form of latent heat. When the heat transfer tube 1 is not vigorously heated, the projections 4 may be relatively increased in size to reduce the volume of the liquefied refrigerant introduced into the tunnel 2. This is conducive to improved heat transfer performance because of a reduction in the regions of the tunnel 2 that are filled with the liquefied refrigerant.

Figure 15:
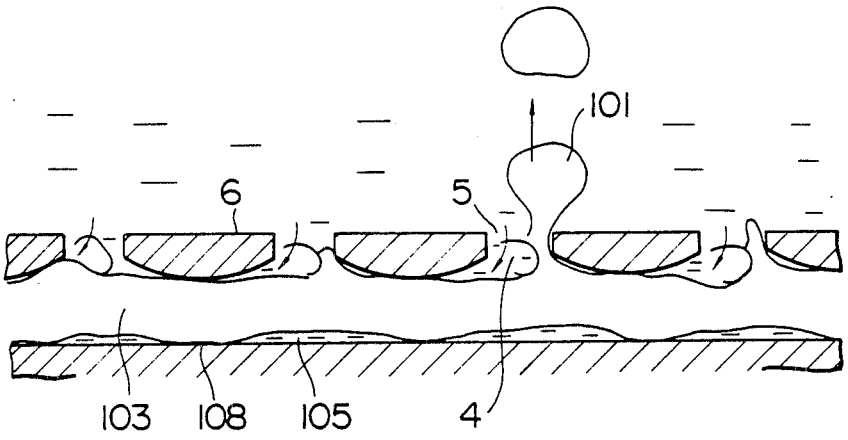

Meanwhile, when the heat transfer tube 1 is vigorously heated, the volume of the gaseous refrigerant produced in the tunnel 2 increases and the volume of the liquefied refrigerant introduced into the tunnel 2 decreases. When this condition occurs, no liquid film is formed on the inner wall surfaces of the tunnel 2 and dried surface portions 108 are formed on the inner wall surfaces of the tunnel 2, as shown in FIG. 15, in which the inner wall surfaces are directly in contact with the gaseous refrigerant. In this case, the transfer of heat in the form of sensible heat to the gaseous refrigerant takes place in regions where the dried surface portions 108 exist, with a result being that the heat transfer performance is greatly reduced as compared with the transfer of heat in the form of latent heat taking place as the thin film of liquid vaporizes. When the heat transfer tube 1 is vigorously heated, the projections 4 may be relatively reduced in size to thereby increase the volume of the liquefied refrigerant introduced into the tunnel 2. This is conducive to improved heat transfer performance because the area of the dried surface portions on the inner wall surfaces of the tunnel 2 is reduced.

From the foregoing description, it will be appreciated that the size of the projection 4 has an optimum range of values which enables a high heat transfer performance to be achieved in accordance with the degree to which the heat transfer wall is heated.

Figure 5:
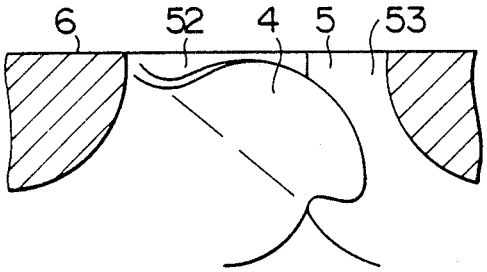
FIG. 5 is a cross-sectional view taken in the direction of arrows V—V in FIG. 2.
Figure 6:
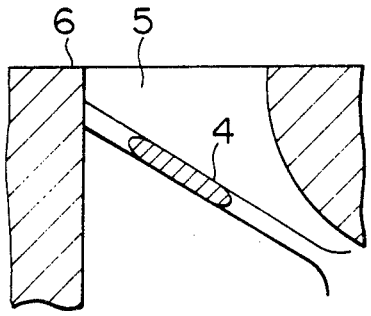
FIG. 6 is a cross-sectional view taken in the direction of the arrow VI—VI in FIG. 2.
Figure 7:
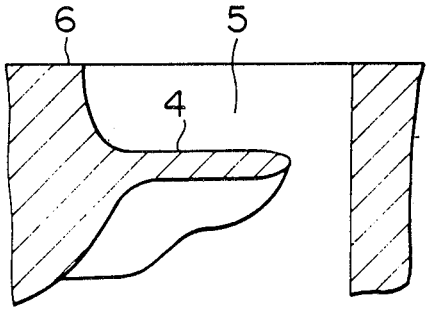
FIG. 7 is a cross-sectional view taken in the direction of arrow VII—VII in FIG. 2.

In the embodiment of the invention shown and described hereinabove, a plurality of tunnels having a maximum height of 0.45 mm, a minimum height of 0.3 mm and a width of 0.25 mm were formed in helical convolutions immediately below the outer surface of a copper tube of an outer diameter of 18 mm and a wall thickness of 1.1 mm. The tunnels which were spaced apart from each other by a spacing interval of 0.5 mm were inclined at an angle which is almost 90 degrees with respect to the center axis of the copper tube 1. A portion of the outer surface of the copper tube lying immediately above each tunnel 2 was rendered smooth except where holes of substantially triangular configuration was provided. The triangular holes, which each have a size equal to that of an imaginary inner circle of a diameter of 0.2 mm, were formed along each of the tunnels with a spacing interval of 0.8 mm. The holes of this construction were each provided with a projection having a base on the side 52 as shown in FIG. 2 and extending across the hole. The projection, which is smaller in size than the hole as viewed two-dimensionally, was inclined by about 45°, so that it was lower in level on the side of the junction of the side 52 and the side 53 than on the side of the junction of the side 52 and the side 51, as shown in FIG. 5.

The ratio $\psi$ of the area of the projection to the area of the hole as shown in FIG. 2 was varied in a range between 0.2 and 0.8. Thus, six kinds of heat transfer wall were produced. Table 1 shows the values of $\psi$ of these six kinds of heat transfer wall.

TABLE 1

| | Mean Value | Range of variations |
|---|---|---|
| Heat Transfer Wall No. 1 | $\psi = 0.29$ | 0.19–0.33 |
| Heat Transfer Wall No. 2 | $\psi = 0.31$ | 0.27–0.36 |
| Heat Transfer Wall No. 3 | $\psi = 0.44$ | 0.37–0.53 |
| Heat Transfer Wall No. 4 | $\psi = 0.60$ | 0.54–0.66 |
| Heat Transfer Wall No. 5 | $\psi = 0.66$ | 0.58–0.74 |

TABLE 1-continued

| | Mean Value | Range of variations |
|---|---|---|
| Heat Transfer Wall No. 6 | $\psi = 0.68$ | 0.61–0.78 |

Figure 16:
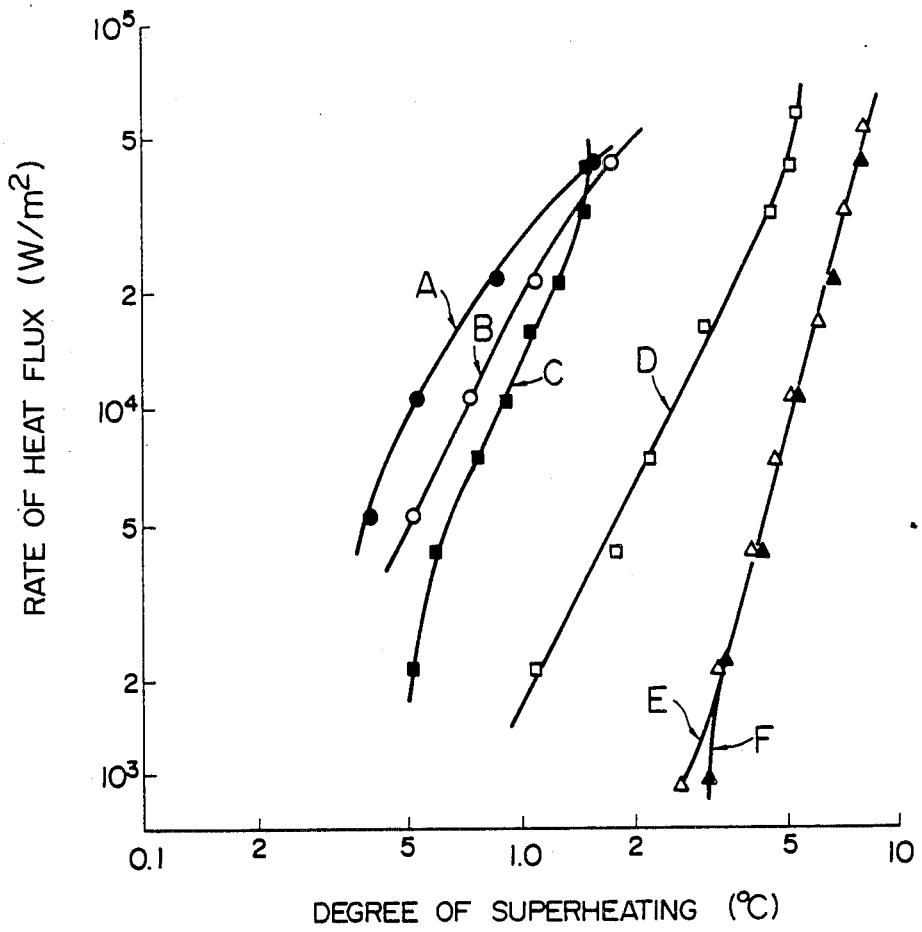
FIG. 16 is a graphical illustration of the heat transfer characteristic of the heat transfer wall comprising one embodiment of the invention.

By using trichlorofluoromethane ($CFCl_3$), experiments were conducted on these six kinds of heat transfer walls to determine the extra-tubular boiling heat transfer characteristic under atmospheric pressure conditions. The results of the experiments are shown in FIG. 16 in which lines A, B, C, D, E and F represent the characteristics of the heat transfer wall No. 4, No. 6, No. 5, No. 3, No. 1 and No. 2, respectively.

Figure 17:
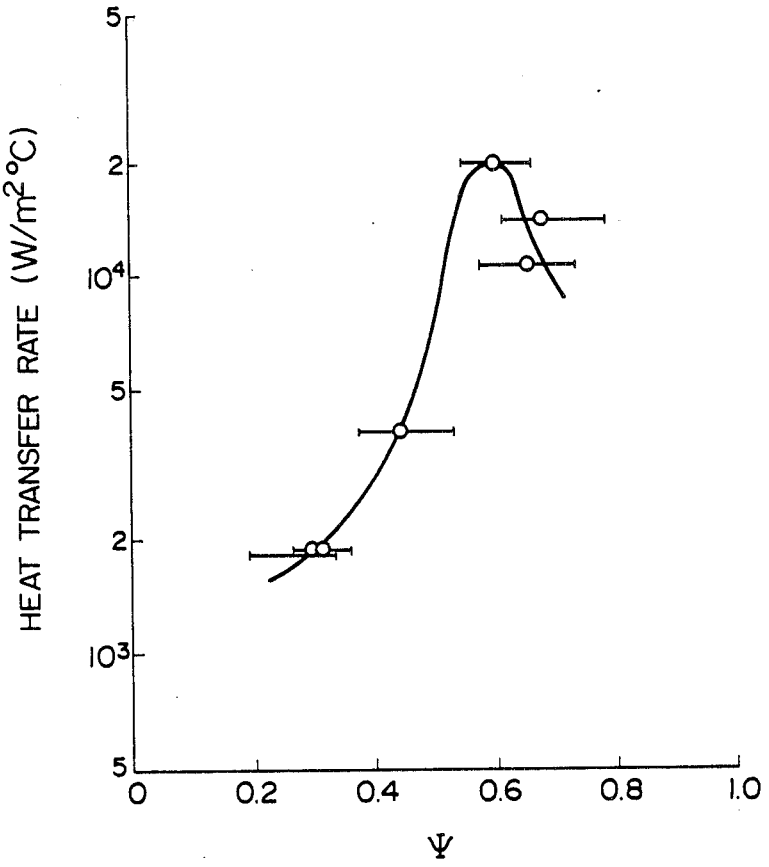
FIG. 17 is a graphical illustration of the relationship between the heat transfer rate and $\psi$.

In an air conditioning system or a refrigerating apparatus, heat transfer tubes having the heat transfer walls described hereinabove are immersed in a refrigerant in a liquid state, such as Freon, and cause the same to boil, to cool water flowing through the heat transfer tubes. In this case, the rate of heat flux used is about $10^4$ W/m$^2$. FIG. 17 shows the relation between the heat transfer rate and the ratio $\psi$ of the area of the projection 4 to the area of the hole 5 which was established by keeping the rate of heat flux constant at $10^4$ W/m$^2$. As can be seen in FIG. 17, the range of the values of $\psi$ that enables a high heat transfer rate to be achieved is between 0.5 and 0.7 as determined based on the mean values of $\psi$, or in the range between 0.4 and 0.8 when the range of variations of the value of $\psi$ for each heat transfer wall is taken into consideration.

Figure 18:
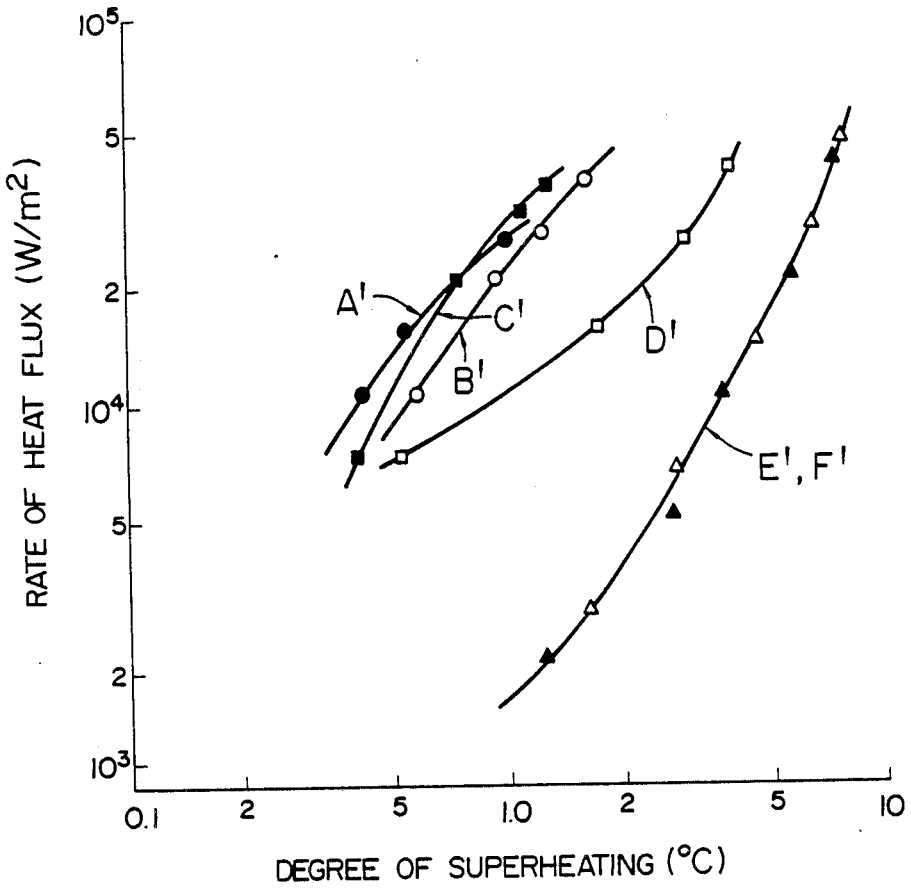
FIG. 18 is a graphical illustration of the heat transfer characteristic of another embodiment of the present invention.

In the foregoing description, the heat transfer wall has been described as being immersed in a liquefied refrigerant and causing same to boil in what is referred to as a pool boiling condition. It is to be understood, however, that the heat transfer wall according to the invention is not limited in use to the immersion in a liquefied refrigerant, and that the invention may have application in a system in which a liquefied refrigerant is dropped or sprayed onto the heat transfer wall to provide a thin coat of refrigerant for vaporization. FIG. 18 shows the results of experiments conducted on the heat transfer walls No. 1 to No. 6 shown in Table 1, as are the experiments whose results are shown in FIG. 16, to determine the extra-tubular thin coat vaporization heat transfer characteristic of the heat transfer walls. In lines A', B', C', D', E' and F' correspond to the heat transfer walls A, B, C, D, E and F, respectively, shown in FIG. 16. It will be seen that the heat transfer walls having an excellent boiling heat transfer characteristic also have an excellent thin coat vaporization heat transfer characteristic, and that the optimum value of $\psi$ for achieving an excellent thin coat vaporization heat transfer characteristic is in the range between 0.5 and 0.7 as determined based on the mean value of $\psi$ or in the range between 0.4 and 0.8 when the range of variations in the value of $\psi$ for each heat transfer wall is taken into consideration.

In the above-described embodiment, the tunnels 2 have been described as being continuous in spiral convolutions. However, the invention is not limited to this specific constructional form of the tunnels 2, and the tunnels 2 may be either linear or annular in constructional form. The heat transfer wall may, of course, be tubular, annular, in plate form or of any other form. The material of the heat transfer wall has been described as being copper. However, the invention is not limited to the heat transfer wall of this specific material, and the heat transfer wall according to the invention may be formed of any metal or alloy as described.

What is claimed is:

1. A method of producing a heat transfer wall for vaporizing liquids, the method comprising the steps of:

forming a plurality of shallow grooves on a surface of said heat transfer walls;

machining the surface of the heat transfer wall across said shallow grooves with a cutting tool so as to scrape the surface of said heat transfer walls without cutting away a surface layer to thereby form a plurality of fins each having a cutout at a forward end portion thereof and a protuberance in a vicinity of a lower portion of the cutout; and bending the forward end portions of said fins in a direction which crosses the fins, so as to bring each fin into contact with the adjacent fin whereby a plurality of elongated minute tunnels having a plurality of holes can be formed, each of said tunnels communicating with the outside through associated holes, each of said holes having a projection located therein and extending into the hole in such a manner so as to traverse the same.

2. A method of producing a heat transfer wall as claimed in claim 1, wherein a machined surface is forcedly deformed in one direction prior to the step of machining the surface of the heat transfer wall being completed, to thereby deform end portions of the shallow grooves on the machined surface.

* * * * *